US010774670B2

(12) United States Patent
Mathew et al.

(10) Patent No.: US 10,774,670 B2
(45) Date of Patent: Sep. 15, 2020

(54) FILLED ABRADABLE SEAL COMPONENT AND ASSOCIATED METHODS THEREOF

(71) Applicant: General Electric Company, Schenectady, NY (US)

(72) Inventors: Paul Mathew, Karnataka (IN); Mohandas Nayak, Karnataka (IN); Krishnendu Saha, Karnataka (IN); Deoras Prabhudharwadkar, Du (AE)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 92 days.

(21) Appl. No.: 15/974,821

(22) Filed: May 9, 2018

(65) Prior Publication Data

US 2018/0355745 A1 Dec. 13, 2018

(30) Foreign Application Priority Data

Jun. 7, 2017 (IN) ..... 201741020031

(51) Int. Cl.
*B22F 7/08* (2006.01)
*F01D 11/12* (2006.01)
(Continued)

(52) U.S. Cl.
CPC ..... *F01D 11/125* (2013.01); *B22F 7/08* (2013.01); *F01D 11/001* (2013.01);
(Continued)

(58) Field of Classification Search
CPC .... F01D 11/125; F01D 11/001; F01D 11/127; B22F 7/08; B22F 1/0059; B22F 2301/15;
(Continued)

(56) References Cited

U.S. PATENT DOCUMENTS 3,867,061 A * 2/1975 Moskowitz ..... F01D 11/127 415/173.3
4,039,296 A * 8/1977 Levinstein ..... B22F 7/04 428/553

(Continued)

FOREIGN PATENT DOCUMENTS

CN 203571042 U 4/2014
WO 95/21319 A1 8/1995

OTHER PUBLICATIONS

Hanks, J., et al., "Materials R&D Priorities for Gas Turbine Based Power Generation," Materials UK, pp. 1-16 (Jul. 10, 2007).

(Continued)

*Primary Examiner* — Aaron R Eastman
*Assistant Examiner* — Theodore C Ribadeneyra
(74) *Attorney, Agent, or Firm* — McNees Wallace & Nurick LLC

(57) ABSTRACT

A filled abradable seal component, an associated method of manufacturing, and a turbomachine including the filled abradable seal component are disclosed. The method includes positioning the abradable seal component including a plurality of honeycomb cells, applying a filler material on the abradable seal component to fill the plurality of honeycomb cells, and curing the filler material at a temperature below 250 degrees Celsius to produce the filled abradable seal component. The filler material includes an abradable material, a binder material, and a fluid catalyst. The abradable material includes at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material includes at least one of aluminum, nickel-aluminum, aluminum thiophosphate, or (Continued)

aluminum thiosulfate. The fluid catalyst includes a solvent having hydroxyl groups.

20 Claims, 8 Drawing Sheets

(51) Int. Cl.
*F01D 11/00* (2006.01)
*B22F 1/00* (2006.01)

(52) U.S. Cl.
CPC ..... *F01D 11/127* (2013.01); *B22F 1/0059* (2013.01); *B22F 2301/15* (2013.01); *B22F 2302/45* (2013.01); *B22F 2998/10* (2013.01); *B22F 2999/00* (2013.01); *F05D 2220/32* (2013.01); *F05D 2230/21* (2013.01); *F05D 2230/40* (2013.01); *F05D 2300/224* (2013.01); *F05D 2300/228* (2013.01); *F05D 2300/43* (2013.01)

(58) Field of Classification Search
CPC ..... B22F 2302/45; B22F 2998/10; B22F 2999/00; F05D 2220/32; F05D 2230/21; F05D 2230/40; F05D 2300/224; F05D 2300/228; F05D 2300/43
See application file for complete search history.

(56) References Cited

U.S. PATENT DOCUMENTS 4,346,904 A 8/1982 Watkins, Jr.
4,395,196 A * 7/1983 Plautz ..... F01D 11/125 415/173.4
4,546,047 A 10/1985 Ryan
4,639,388 A * 1/1987 Ainsworth ..... B32B 15/04 428/117
4,669,955 A 6/1987 Pellow
4,834,800 A * 5/1989 Semel ..... B22F 1/0059 106/403
4,867,639 A * 9/1989 Strangman ..... F01D 11/12 415/173.4
5,096,376 A * 3/1992 Mason ..... F01D 11/02 277/414
6,235,370 B1 5/2001 Merrill et al.
6,251,494 B1 * 6/2001 Schreiber ..... F01D 11/127 228/181
6,341,938 B1 * 1/2002 Zegarski ..... F01D 11/127 415/173.4
6,485,025 B1 11/2002 Hammersley et al.
6,644,914 B2 11/2003 Lawer et al.
6,745,931 B2 6/2004 Karl et al.
6,884,502 B2 4/2005 Berkeley et al.
8,318,251 B2 11/2012 Cavanaugh et al.
2002/0110451 A1 * 8/2002 Albrecht, Jr. ..... F01D 5/225 415/173.4
2002/0158417 A1 * 10/2002 Wallace ..... C23C 8/06 277/414
2004/0219010 A1 * 11/2004 Merrill ..... C04B 38/0038 415/173.4
2006/0131815 A1 * 6/2006 Meier ..... F01D 11/127 277/414
2008/0260522 A1 * 10/2008 Alvanos ..... F01D 11/001 415/173.4
2010/0178169 A1 * 7/2010 Webb ..... F01D 5/087 416/95
2011/0248452 A1 * 10/2011 John ..... F01D 11/127 277/414
2013/0119617 A1 * 5/2013 Alvanos ..... F01D 11/001 277/628
2013/0168927 A1 * 7/2013 Simpson ..... F01D 11/001 277/414
2013/0175325 A1 * 7/2013 Lin ..... C23C 10/48 228/124.1
2013/0241153 A1 * 9/2013 Garrison ..... F01D 11/02 277/350
2015/0050129 A1 * 2/2015 Barron ..... F02B 37/24 415/162
2015/0093506 A1 * 4/2015 Bucci ..... F01D 11/125 427/261
2015/0114373 A1 * 4/2015 Beasley ..... F02F 1/00 123/668
2016/0123160 A1 * 5/2016 Strock ..... B32B 3/12 428/116
2016/0230582 A1 * 8/2016 Schlothauer ..... F01D 11/08
2016/0312628 A1 * 10/2016 Kirby ..... C04B 41/87
2016/0312897 A1 * 10/2016 Eastman ..... F01D 11/122
2017/0058689 A1 * 3/2017 Gaebler ..... F04D 29/526
2017/0274441 A1 * 9/2017 Giardini ..... B23P 15/00
2017/0284212 A1 * 10/2017 Kloetzer ..... F01D 5/02
2017/0335708 A1 * 11/2017 Kray ..... F01D 11/08

OTHER PUBLICATIONS

Shiembob, L. T., "Continued development of abradable gas path seals", Pratt and Whitney Aircraft, pp. 98, Nov. 1, 1975).
Oerlikon Metco, CoNiCrAlY-BN / Polyester Abradable Thermal Spray Powders, DSMTS-0011.8, published 2018, retrieved Mar. 3, 2020.

* cited by examiner

FILLED ABRADABLE SEAL COMPONENT AND ASSOCIATED METHODS THEREOF

BACKGROUND

Embodiments of the disclosed technique relate to turbomachines, and more specifically to a filled abradable seal component, an associated method of manufacturing, the turbomachines including the filled abradable seal component, and regulating windage heating in turbomachines.

Seals are often used to minimize leakage of fluid in a clearance defined between a stationary component and a rotatable component of a turbomachine. Typically, seal includes teeth formed on the rotatable component thereby obstructing a flow of the fluid and minimizing the leakage of the fluid through the clearance. However, during certain transient operational conditions of the turbomachine such as startup, the rotatable component may move along an axial direction or a radial direction in relation to the stationary component. Such movement of the rotatable component may cause the teeth to rub against the stationary component, resulting in damage of the teeth and the stationary component. To address such problems, in the art, an abradable honeycomb seal component including a plurality of honeycomb cells is coupled to the stationary component. Thus, during such movement of the rotatable component, the teeth may rub against the abradable honeycomb seal component, without damaging the teeth and the stationary component. However, the plurality of honeycomb cells in the abradable honeycomb seal component may entrap some portion of the fluid, resulting in losing swirling motion of the fluid along the clearance and increasing tangential slip between the fluid and the rotatable component, thereby increasing windage heating along the clearance. Accordingly, there is a need for an improved abradable seal component, an associated method for manufacturing the improved abradable seal component, and regulating windage heating of fluid in a clearance of a turbomachine.

BRIEF DESCRIPTION

In accordance with one example embodiment, a method of manufacturing a filled abradable seal component for a turbomachine is disclosed. The method includes positioning an abradable seal component including a plurality of honeycomb cells. Further, the method includes applying a filler material on the abradable seal component to fill the plurality of honeycomb cells. The filler material includes an abradable material, a binder material, and a fluid catalyst. The abradable material includes at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material includes at least one of aluminum, nickel-aluminum, aluminum thiophosphate, or aluminum thiosulfate. The fluid catalyst includes a solvent having hydroxyl groups. The method further includes curing the filler material within the plurality of honeycomb cells at a temperature below 250 degrees Celsius to produce the filled abradable seal component.

In accordance with another example embodiment, a filled abradable seal component for a turbomachine is disclosed. The abradable seal component includes a plurality of honeycomb cells filled with a filler material, where the filler material is bonded to one or more side walls of the plurality of honeycomb cells. The filler material includes an abradable material, a binder material, and a fluid catalyst. The abradable material includes at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material includes at least one of aluminum, nickel-aluminum, aluminum thiophosphate, or aluminum thiosulfate. The fluid catalyst includes a solvent having hydroxyl groups.

In accordance with yet another example embodiment, a turbomachine is disclosed. The turbomachine includes a stationary component, a rotatable component, and a filled abradable seal component. The filled abradable seal component is coupled to either one of the stationary component or the rotatable component of the turbomachine and facing teeth of other of the stationary component or the rotatable component to define a clearance there between the filled abradable seal component and the other of the stationary component or the rotatable component. The filled abradable seal component includes an abradable seal component including a plurality of honeycomb cells filled with a filler material. The filler material is bonded to one or more side walls of the plurality of honeycomb cells. The filler material includes an abradable material, a binder material, and a fluid catalyst. The abradable material includes at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material includes at least one of aluminum, nickel-aluminum, aluminum thiophosphate, or aluminum thiosulfate. The fluid catalyst includes a solvent having hydroxyl groups.

DRAWINGS

These and other features and aspects of embodiments of the present disclosure will become better understood when the following detailed description is read with reference to the accompanying drawings in which like characters represent like parts throughout the drawings, wherein.

DETAILED DESCRIPTION

Figure 1:
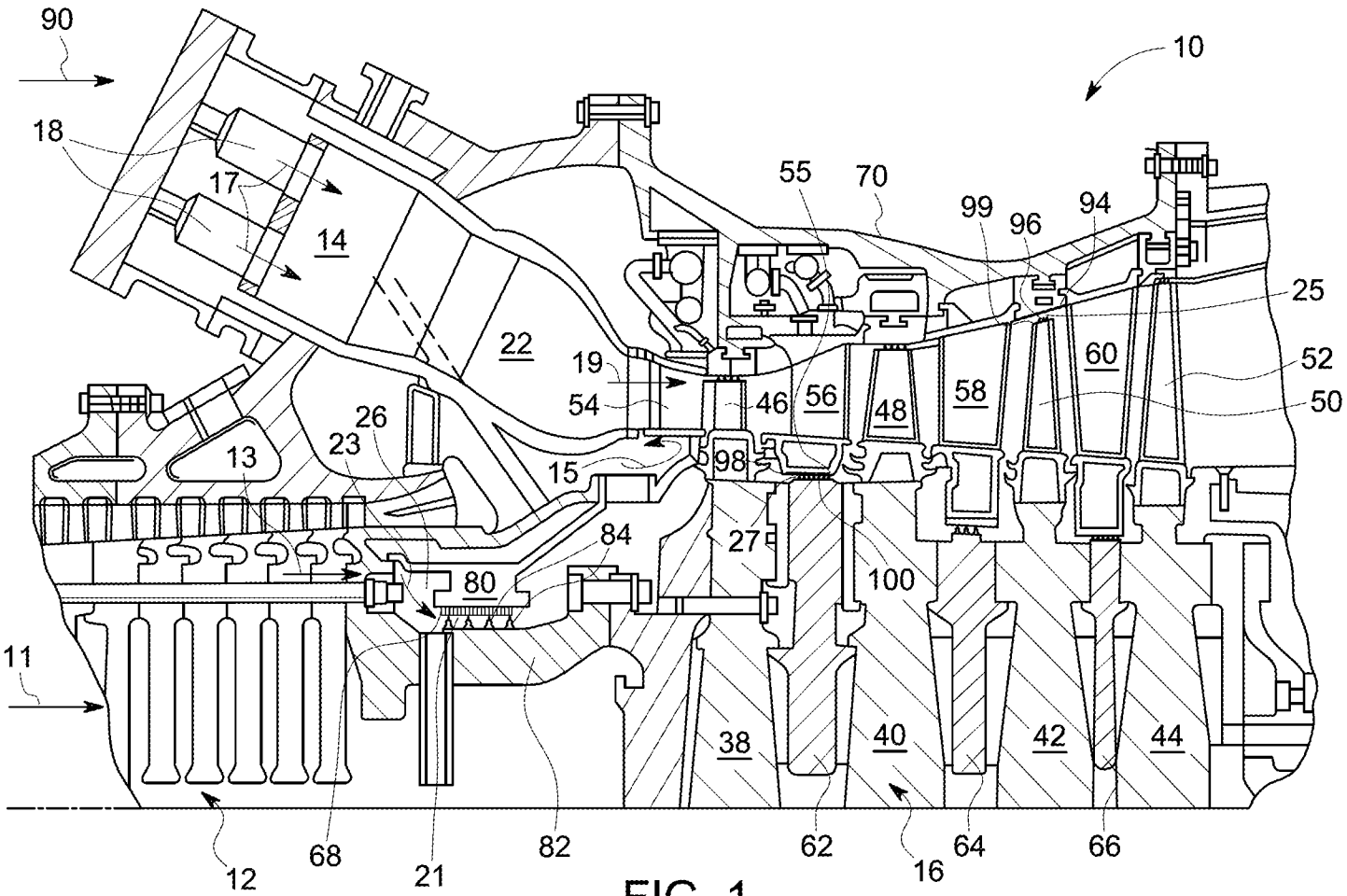
FIG. 1 is a cross-sectional view of a portion of a turbomachine in accordance with one example embodiment of the present disclosure.

To more clearly and concisely describe and point out the subject matter, the following definitions are provided for specific terms, which are used throughout the following description and the appended claims, unless specifically denoted otherwise with respect to a particular embodiment. The term "melting point" as used in the context refers to liquefaction point of a material. Specifically, the melting point of the material refers to a temperature at which the material changes its physical state from solid to liquid, at atmospheric pressure. The term "solvent" as used in the context refers to a substance that is used to dissolve two materials. The term "hydroxyl groups" as used in the context refers to the chemical moiety "—OH".

Embodiments of the present disclosure discussed herein relate to a method of manufacturing a filled abradable seal component. In some embodiments, such a filled abradable seal component may be used to regulate windage heating in a turbomachine. In certain embodiments, the method includes positioning an abradable seal component including a plurality of honeycomb cells. Further, the method includes applying a filler material on the abradable seal component to fill the plurality of honeycomb cells. The method further includes curing the filler material within the plurality of honeycomb cells at a temperature below 250 degrees Celsius to produce the filled abradable seal component. In some embodiments, the filler material includes an abradable material, a binder material, and a fluid catalyst. In some embodiments, the abradable material includes at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material includes at least one of aluminum, nickel-aluminum, aluminum thiophosphate, or aluminum thiosulfate. The fluid catalyst includes a solvent having hydroxyl groups. In some specific embodiments, the fluid catalyst is water. In certain embodiments, the curing of the filler material within the plurality of honeycomb cells is performed below a melting point of the filler material.

In some embodiments, applying the filler material includes i) mixing the abradable material and the binder material to produce a mixture, ii) filling the mixture in the plurality of honeycomb cells, and iii) providing the fluid catalyst to the mixture filled in the plurality of honeycomb cells. In some embodiments, a volume ratio of the abradable material to the binder material in the filler material to produce the mixture is in a range from 0.5 to 3. In certain embodiments, filling the mixture includes transferring the mixture into the plurality of honeycomb cells to fill the honeycomb cells. In some embodiments, providing the fluid catalyst includes spraying or wetting the fluid catalyst (e.g., water or alcohol) on the mixture filled in the plurality of honeycomb cells. The fluid catalyst initiates reaction of the mixture to produce a reacted mixture and bond the reacted mixture to one or more side walls of the plurality of honeycomb cells. In some other embodiments, providing the fluid catalyst includes disposing the abradable seal component having the mixture filled in the plurality of honeycomb cells over a pack of ice. In such an embodiment, the pack of ice may allow condensation of water (i.e., the fluid catalyst) on the mixture from atmosphere. Upon contacting with the mixture, water, initiates a chemical reaction of the mixture to form a reacted mixture and facilitates the bonding of the reacted mixture to one or more side walls of the plurality of honeycomb cells. In such an embodiment, curing the filler material includes disposing the abradable seal component including the plurality of filled honeycomb cells in a heater such as oven to remove excess water from the mixture, and produce the filled abradable seal component.

In one example embodiment, the abradable material is nickel chromium aluminum-bentonite, the binder material is aluminum, and the fluid catalyst is water. In some embodiments, a volume ratio of the nickel chromium aluminum-bentonite to the aluminum in the filler material to produce the mixture is in a range from 0.5 to 3. In some other embodiments, a volume ratio of the nickel chromium aluminum-bentonite to the aluminum in the filler material to produce the mixture is in a range from 0.7 to 2. In one example embodiment, the volume ratio of the nickel chromium aluminum-bentonite to the aluminum in the filler material to produce the mixture is 1. In some embodiments, the curing the filler material including nickel chromium aluminum-bentonite, aluminum and water in the plurality of honeycomb cells is performed at a temperature below 250 degrees Celsius at atmospheric pressure to produce the filled abradable seal component. In some other embodiment, the curing is performed below 100 degrees Celsius. In some example embodiment, the curing is performed below 50 degrees Celsius. Further, in such embodiment, curing is performed at a room temperature. For example, the room temperature is in a range from 20 degrees Celsius to 30 degrees Celsius. In some specific examples, the room temperature is in a range from 20 degrees Celsius to 30 degrees Celsius at atmospheric pressure.

In some other embodiments, applying the filler material includes i) mixing the abradable material and the binder material to produce a mixture, ii) mixing the fluid catalyst with the mixture to produce a slurry, and iii) filling the slurry in the plurality of honeycomb cells. In one embodiment, the steps (i) and (ii) are performed simultaneously. In another embodiment, the steps (i) and (ii) are performed sequentially. In some embodiments, filling the slurry includes pouring the slurry into the plurality of honeycomb cells to fill the plurality of honeycomb cells. In some other embodiments, filling the slurry includes dipping the abradable seal component in the slurry of filler material to fill the plurality of honeycomb cells.

FIG. 1 illustrates a cross-sectional view of a portion of a turbomachine such as a gas turbine engine 10 in accordance with one example embodiment. The gas turbine engine 10 includes a compressor 12, a combustor 14, and a turbine 16. In the illustrated embodiment, the compressor 12 is a multistage compressor and the turbine 16 is a multistage turbine. The compressor 12 is coupled to the combustor 14. The turbine 16 is coupled to the combustor 14 and the compressor 12. A leakage flow path 26 extends from the compressor 12 to the turbine 16 bypassing the combustor 14. During operation, the compressor 12 is configured to receive a fluid 11, such as air and compress the received fluid 11 to generate a compressed fluid 13, which typically has a swirling motion. The combustor 14 is configured to receive a main compressed fluid 15 from the compressor 12 and a fuel 17, such as natural gas, from a plurality of fuel injectors 18 and burn the fuel 17 and the main compressed fluid 15 within a combustion zone 22 to generate exhaust gases 19. The turbine 16 is configured to receive the exhaust gases 19 from the combustor 14 and expand the exhaust gases 19 to convert energy of the exhaust gases 19 to work. The turbine 16 is configured to drive the compressor 12 through a mid-shaft 82. It should be noted herein that the term "main compressed fluid" as used in the context refers to a major portion or fraction of the compressed fluid 13 discharged from the compressor 12. In some embodiments, the major portion means more than 80 percent. The compressor 12 is further configured to release a bypass compressed fluid 23 to the turbine 16 via the leakage flow path 26. The terms "bypass compressed fluid" as used in the context refers to a minor portion or fraction of the compressed fluid 13 discharged from the compressor 12. In some embodiments, the minor portion means less than 20 percent.

In the illustrated embodiment, the turbine 16 includes four-stages represented by four rotors 38, 40, 42, 44 connected to the mid-shaft 82 for rotation therewith. Each rotor 38, 40, 42, 44 includes airfoils such as rotor blades 46, 48, 50, 52, which are arranged alternately between nozzles such as stator blades 54, 56, 58, 60 respectively. The stator blades 54, 56, 58, 60 are fixed to a turbine casing 70 of the turbine 16. The turbine 16 further includes three spacer wheels 62, 64, 66 coupled to and disposed alternately between rotors 38, 40, 42, 44. Specifically, the turbine 16 includes a first stage having the stator blade 54 and the rotor blade 46, a second stage having the stator blade 56, the spacer wheel 62, and the rotor blade 48, a third stage having the stator blade 58, the spacer wheel 64, and the rotor blade 50, and a fourth stage having the stator blade 60, the spacer wheel 66, and the rotor blade 52.

The gas turbine engine 10 further includes a stationary component such as a compressor discharge casing 80, a rotatable component such as the mid-shaft 82, and a filled abradable seal component 68. In such an embodiment, the filled abradable seal component 68 is disposed in the leakage flow path 26. Specifically, the filled abradable seal component 68 is coupled to the compressor discharge casing 80 facing the mid-shaft 82 having teeth 84 to define a clearance 21 there between the compressor discharge casing 80 and the mid-shaft 82. Specifically, the clearance 21 is defined between the compressor discharge casing 80 and the mid-shaft 82. In some embodiments, the filled abradable seal component 68 includes a plurality of honeycomb cells (not shown) filled with a filler material (not shown), which is bonded to one or more side walls of the plurality of honeycomb cells. Further, the filled abradable seal component 68 may include a plurality of grooves (not shown), where individual grooves of the plurality of grooves may be spaced apart from each other along the axial direction 90 of the gas turbine engine 10. During operation, the filled abradable seal component 68 is configured to regulate windage heating along the clearance 21. Further, the plurality of grooves is configured to control leakage of a bypass compressed fluid 23 flowing through the clearance 21. The filled abradable seal component 68 is discussed in greater detail below with reference to subsequent figures.

The gas turbine engine 10 further includes a stationary component such as the turbine casing 70, a rotatable component such as the rotor blade 50, and a filled abradable seal component 94. In such an embodiment, the filled abradable seal component 94 is coupled to the turbine casing 70 facing teeth 96 at a tip 99 of the rotor blade 50 to define a clearance 25 there between the tip 99 of the rotor blade 50 and the turbine casing 70. The filled abradable seal component 94 may be similar to the filled abradable seal component 68. In such an embodiment, the filled abradable seal component 94 is configured to regulate windage heating along the clearance 25 and to control leakage of the exhaust gases 19 through the clearance 25, bypassing the rotor blade 50. Although not illustrated, in certain embodiments, the filled abradable seal component 94 may be coupled to the turbine casing 70 facing teeth (not labeled) of respective rotor blades 46, 48, 52 to define a clearance (not labeled) there between the respective rotor blades 46, 48, 52 and the turbine casing 70.

The gas turbine engine 10 further includes a stationary component such as the stator blade 56, a rotatable component such as the spacer wheel 62, and a filled abradable seal component 98. In such an embodiment, the filled abradable seal component 98 is coupled to a tip 55 of the stator blade 56 facing teeth 100 in the spacer wheel 62 to define a clearance 27 there between the tip 55 of the stator blade 56 and the spacer wheel 62. The filled abradable seal component 98 may be similar to the filled abradable seal component 68. In such an embodiment, the filled abradable seal component 98 is configured to regulate windage heating along the clearance 27 and to control leakage of the exhaust gases 19 through the clearance 27. Although not illustrated, the filled abradable seal component 98 may be coupled to the tip (not labeled) of the respective stator blades 58, 60 facing teeth (not labeled) formed in the respective spacer wheels 64, 66.

Figure 2:
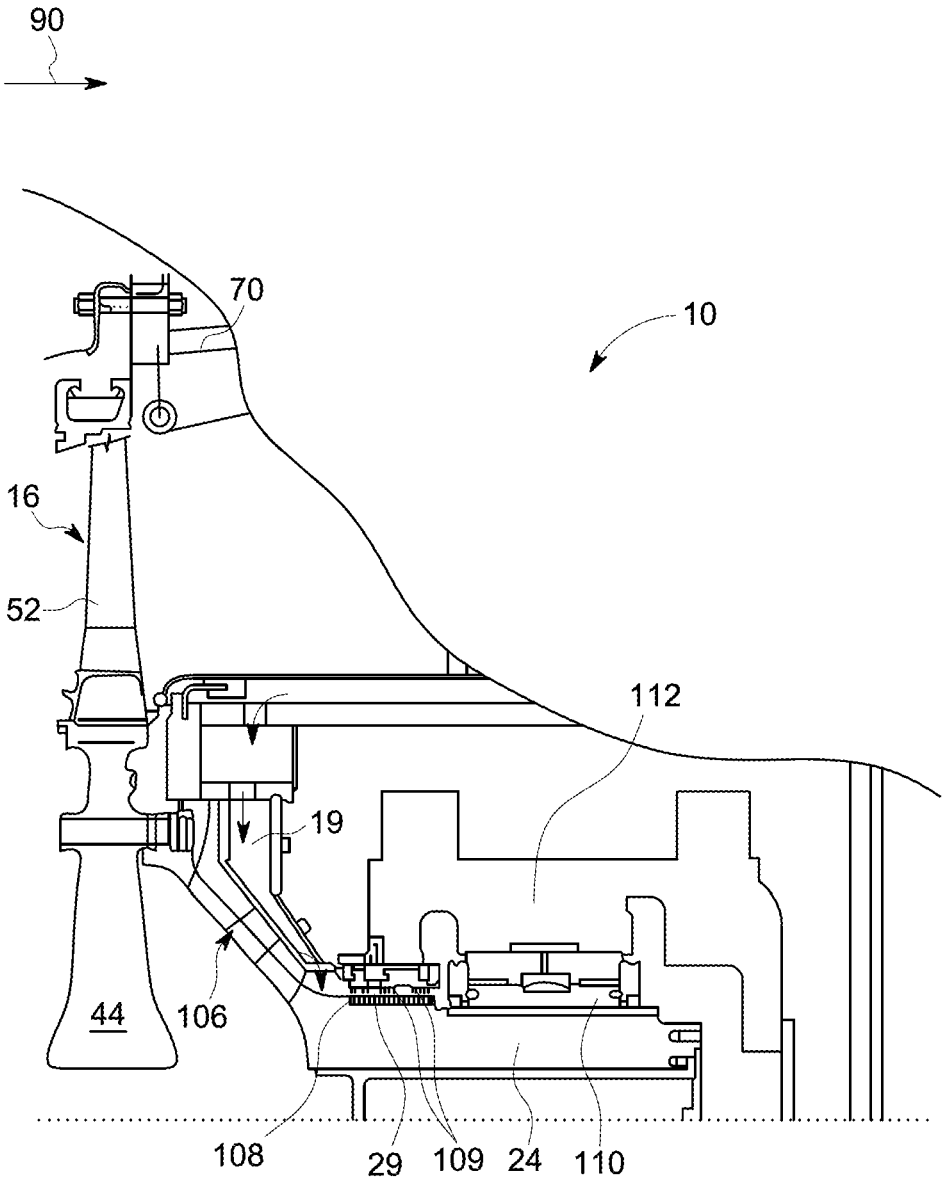
FIG. 2 is a cross-sectional view of another portion of the turbomachine of FIG. 1 in accordance with one example embodiment of the present disclosure.

FIG. 2 illustrates a cross-sectional view of another portion of the gas turbine engine 10 of FIG. 1 in accordance with one example embodiment. In some embodiments, the gas turbine engine 10 includes a stationary component such as a bearing housing 112, a rotatable component such as an aft-shaft 24, and a filled abradable seal component 108. In the illustrated embodiment, a turbine 16 of the gas turbine engine 10 includes a rotor blade 52 mounted on a rotor 44 of the last stage of the gas turbine engine 10. The rotor 44 is coupled to the aft-shaft 24 via a connecting element 106 and the aft-shaft 24 is supported by a bearing 110 disposed within the bearing housing 112. The filled abradable seal component 108 is coupled to aft-shaft 24 and facing teeth 109 of the bearing housing 112 to define a clearance 29 there between the aft-shaft 24 and the bearing housing 112. In such an embodiment, the filled abradable seal component 108 is configured to regulate windage heating along the clearance 29 and to control leakage of a portion of the exhaust gases 19 through the clearance 29.

Figure 3:
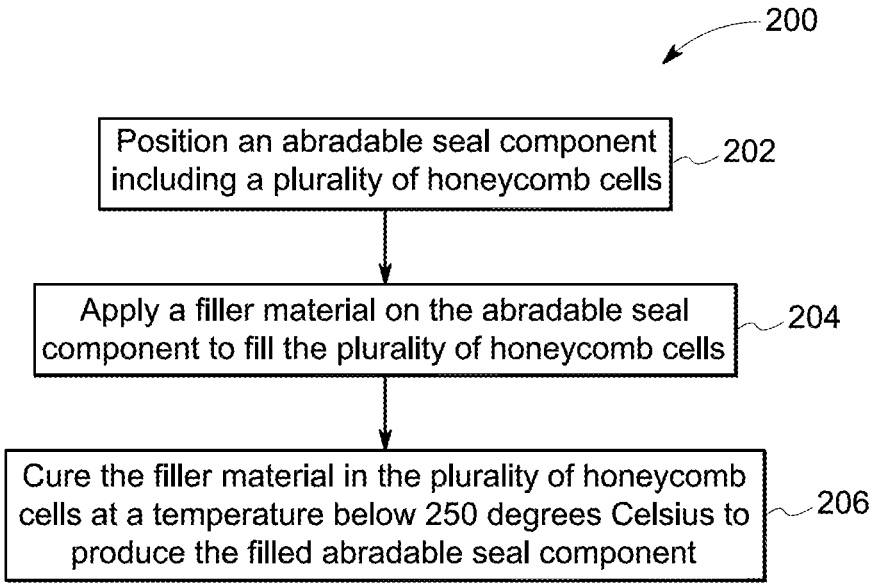
FIG. 3 is a flow diagram of a method of manufacturing a filled abradable seal component in accordance with one example embodiment of the present disclosure.

FIG. 3 is a flow diagram of a method 200 of manufacturing a filled abradable seal component in accordance with one example embodiment. In one embodiment, the method 200 includes a step 202 of positioning an abradable seal component including a plurality of honeycomb cells. The abradable seal component includes a plurality of honeycomb cells disposed adjacent to each other along an axial direction and a circumferential direction of the turbomachine. In some embodiments, the step 202 of positioning the abradable seal component includes accessing a turbomachine during maintenance of the turbomachine, where the turbomachine includes the abradable seal component including a plurality of honeycomb cells, coupled to the turbomachine. In some other embodiments, the step 202 of positioning the abradable seal component includes receiving the abradable seal component including a plurality of honeycomb cells, which is not coupled to the turbomachine. In some other embodiments, the step 202 of positioning the abradable seal component may include forming the abradable seal component including a plurality of honeycomb cells directly on a surface of either one of the stationary component or the rotatable component using an additive manufacturing technique. In some other embodiments, the step 202 of positioning the abradable seal component may include receiving the abradable seal component including a plurality of honeycomb cells and coupling the abradable seal component to the surface of either one of the stationary component or the rotatable component by brazing.

The method 200 further includes a step 204 of applying a filler material on the abradable seal component to fill the plurality of honeycomb cells. In one embodiment, the filler material includes an abradable material, a binder material, and a fluid catalyst. In certain embodiments, the abradable material includes at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material includes at least one of aluminum, nickel-aluminum, aluminum thiophosphate, or aluminum thiosulfate. The fluid catalyst includes a solvent including hydroxyl groups. In certain embodiments, the solvent may be an alcohol, water, water-alcohol mixture, an aqueous hydroxide, or combination thereof. Suitable alcohols that may be used in the methods disclosed herein include, but not limited to, methanol, ethanol, and isopropyl alcohol. In one specific embodiment, the aqueous hydroxide is an aqueous solution of metal hydroxide. In one example embodiment, the abradable material is nickel chromium aluminum-bentonite, the binder material is aluminum, and the fluid catalyst is water. In some embodiment, the volume ratio of the nickel chromium aluminum-bentonite to aluminum in the filler material is 1. In another example embodiment, the abradable material is nickel graphite, the binder material is nickel-aluminum, and the fluid catalyst is alcohol, water, or combination of water and alcohol. In yet another example embodiment, the abradable material is cobalt nickel chromium aluminum yttrium-boron nitride, the binder is aluminum thiosulfate, and the fluid catalyst is an aqueous hydroxide.

In some embodiments, the step 204 of applying a filler material on the abradable seal component includes sub-steps (i) of mixing the abradable material and the binder material to produce a mixture, (ii) of filling the mixture in the plurality of honeycomb cells, and (iii) of providing the fluid catalyst to the mixture filled in the plurality of honeycomb cells. In some embodiments, the sub-step (i) of mixing the abradable material and the binder material includes selecting the abradable material to the binder material in a volume ratio ranging from 0.5 to 3. In one example embodiment, the volume ratio of the nickel chromium aluminum-bentonite to aluminum in the filler material is 1. In such an example embodiment, the mixture of nickel chromium aluminum-bentonite to aluminum in the volume ratio of 1 may be obtained by mixing 29 grams of nickel chromium aluminum-bentonite with 11 grams of aluminum. In certain embodiments, the sub-step (i) of mixing the abradable material and the binder material may be performed using a mixer machine such as a mechanical mill. It should be noted herein that the mechanical mill may be a grinder, which may be configured to grind and blend the abradable material and the binder material to form the mixture. In some embodiments, the sub-step (ii) of filling the mixture in the plurality of honeycomb cells includes transferring the mixture into the plurality of honeycomb cells. In certain embodiments, the abradable seal component may be disposed on an agitator machine such as a mechanical vibrator while transferring the mixture into the plurality of honeycomb cells to maximize pack density of the mixture in the plurality of honeycomb cells. In other words, the use of mechanical vibrator may ensure that there are no voids left within the honeycomb cells during transferring the mixture into the plurality of honeycomb cells. In certain embodiments, transferring the mixture into the plurality of honeycomb cells includes completely or partially filling an internal volume of the plurality of honeycomb cells. In some embodiments, the term "partially filling" may refer to filling at least 80 percent to 95 percent of the internal volume of the plurality of honeycomb cells. Similarly, the term "completely filling" refers to filling 100 percent of the internal volume of the plurality of honeycomb cells. In some embodiments, the sub-step (iii) of providing the fluid catalyst to the mixture filled in the plurality of honeycomb cells includes spraying or wetting the fluid catalyst such as water on the plurality of honeycomb cells filled with the mixture, thereby initiating a reaction such as hydrolysis to form the reacted mixture and bond the reacted mixture within and to one or more side walls of the plurality of honeycomb cells. For example, water may be sprayed on the plurality of filled honeycomb cells for initiating the reaction between the nickel chromium aluminum-bentonite and aluminum. It should be noted herein that the "hydrolysis" refers to reaction, which forms the bonds of the mixture with the fluid catalyst (e.g., water or alcohol). In certain embodiment, hydrolysis may be exothermic in nature, thereby resulting in bonding the resultant reacted mixture of nickel chromium aluminum-bentonite and aluminum to one or more sidewalls of the plurality of honeycomb cells. In some embodiments, the term "bonding" as used in the context herein means either chemically joining or physically joining the resultant reacted mixture of nickel chromium aluminum-bentonite and aluminum to the one or more side walls of the plurality of honeycomb cells. In one example embodiment, the resultant reacted mixture of nickel chromium aluminum-bentonite and aluminum is chemically bonded to the one or more side walls of the plurality of honeycomb cells, when the resultant reacted mixture forms a surface oxide layer there between. In some other embodiments, the term "bonding" as used in the context means cementing the resultant reacted mixture of nickel chromium aluminum-bentonite and aluminum to the one or more side walls of the plurality of honeycomb cells such that the resultant reacted mixture is retained within the plurality of honeycomb cells. In one example embodiment, the resultant reacted mixture of nickel chromium aluminum-bentonite and aluminum is physically bonded to the one or more side walls of the plurality of honeycomb cells, when the resultant reacted mixture forms cement there between. In some embodiment, the fluid catalyst such as water may be sprayed on a plastic sheet and cover the plastic sheet including the sprayed water over the abradable seal component. In such an embodiment, the water in vapor form may condense into the mixture filled in the plurality of honeycomb cells, thereby initiating hydrolysis reaction. In some other embodiments, the sub-step (iii) of providing the fluid catalyst to the mixture filled in the plurality of filled honeycomb cells includes disposing the abradable seal component including the mixture filled in the plurality of honeycomb cells on a pack of ice. It should be noted herein that the term "pack of ice" includes, but not limited to, to a group of ice formed by freezing of water such as sea water, or hard water, or drinking water, and the like. The pack of ice may result in condensation of water from an atmosphere on the mixture of nickel chromium aluminum-bentonite and aluminum, thereby initiating reaction of the mixture, and bond the resultant reacted mixture of nickel chromium aluminum-bentonite and aluminum to one or more side walls of the plurality of honeycomb cells. In some embodiments, subsequent to the sub-step (iii) the reaction of nickel chromium aluminum-bentonite and aluminum may result in marginally reducing quantity of the resultant reacted mixture within the plurality of honeycomb cells, thereby increasing the density of the resultant reacted mixture. For example, the resultant reacted mixture of nickel chromium aluminum-bentonite and aluminum may get reduced by 5 percent of the internal volume of the plurality of honeycomb cells.

In some other embodiments, the step 204 of applying a filler material on the abradable seal component includes a sub-steps (i) of mixing the abradable material and the binder material to produce a mixture (ii) of mixing the fluid catalyst with the mixture to produce a slurry, and (iii) of filling the slurry in the plurality of honeycomb cells. In one embodiment, the sub-steps (i) and (ii) may be performed simultaneously. In another embodiment, the sub-steps (i) and (ii) may be performed sequentially. In some embodiments, the sub-step (ii) of mixing the fluid catalyst with the mixture includes mixing water with the mixture of nickel chromium aluminum-bentonite and aluminum to form the slurry of nickel chromium aluminum-bentonite and aluminum in water. In some embodiments, the sub-step (iii) of filling the slurry includes pouring the slurry into the plurality of honeycomb cells to fill the slurry into the plurality of honeycomb cells. As discussed herein, the slurry may react and bond with one or more side walls of the plurality of honeycomb cells. In some other embodiments, the sub-step (iii) of filling the slurry includes dipping the abradable seal component in the slurry of nickel chromium aluminum-bentonite and aluminum to fill the plurality of honeycomb cells. The slurry may react and bond with one or more side walls of the plurality of honeycomb cells.

The method 200 further includes a step 206 of curing the filler material within the plurality of honeycomb cells at a temperature below 250 degrees Celsius to produce the filled abradable seal component. In some embodiments, curing the filler material (i.e., bonded filler material) includes disposing the abradable seal component including the filler material within the plurality of honeycomb cells in a heating machine such as oven to remove excess fluid catalyst (e.g., water or alcohol) from the bonded filler material and produce the filled abradable seal component. In some embodiments, the curing the filler material is performed at a temperature below 250 degrees Celsius at atmospheric pressure to produce the filled abradable seal component. In some other embodiment, the curing is performed below 100 degrees Celsius. In some example embodiment, the curing is performed below 50 degrees Celsius. Further, in such embodiment, curing is performed at a room temperature. For example, the room temperature is in a range from 20 degrees Celsius to 30 degrees Celsius. In some specific examples, the room temperature is in a range from 20 degrees Celsius to 30 degrees Celsius at atmospheric pressure. The atmospheric pressure may be in a range from 80 kilopascals to 100 kilopascals. In certain embodiments, curing is performed below the melting point of the filler material. In one specific example, curing is performed below the melting point of the nickel chromium aluminum-bentonite and aluminum materials. It should be noted herein that the melting point of the mixture of nickel chromium aluminum-bentonite and aluminum may be above 800 degrees Centigrade. In one example embodiment, the filled abradable seal component manufactured as per the foregoing steps discussed herein includes the abradable seal component including the plurality of honeycomb cells filled with the nickel chromium aluminum-bentonite and aluminum, which are bonded to one or more side walls of the plurality of honeycomb cells to form the filled abradable seal component.

Figure 4:
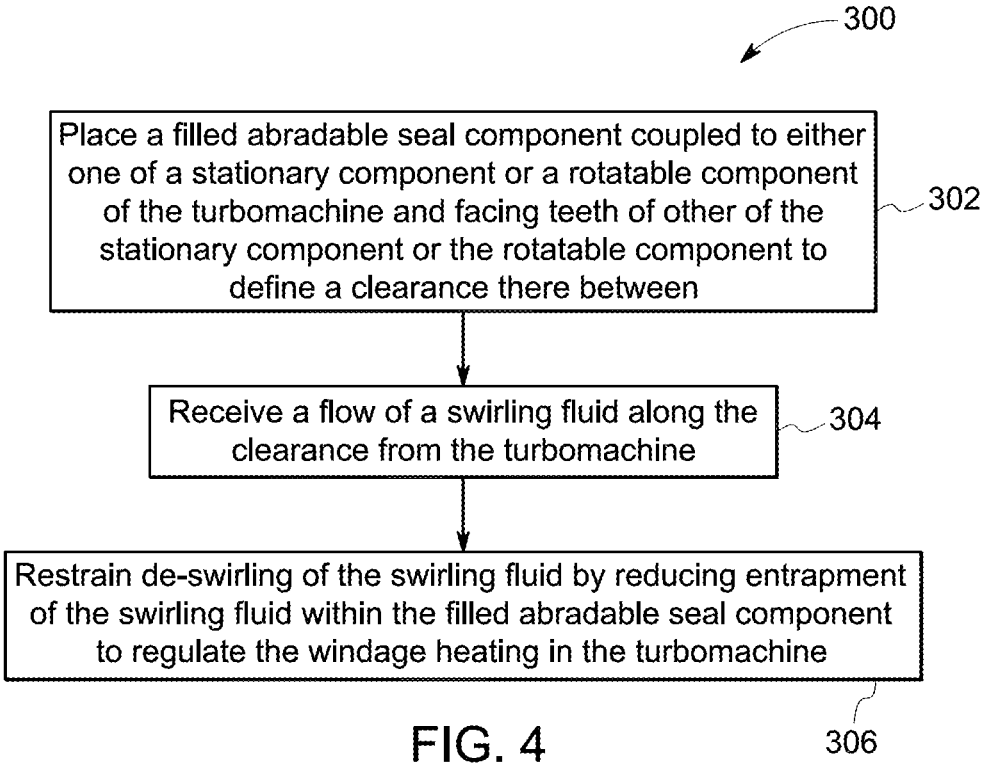
FIG. 4 is a flow diagram of a method for regulating windage heating in a turbomachine in accordance with one example embodiment of the present disclosure.

FIG. 4 is a flow diagram of a method 300 for regulating windage heating in a turbomachine in accordance with one example embodiment. In one embodiment, the method 300 includes a step 302 of placing a filled abradable seal component coupled to either one of a stationary component or a rotatable component of the turbomachine and facing teeth of other of the stationary component or the rotatable component to define a clearance there between. In one example embodiment, the filled abradable seal component includes the abradable seal component including the plurality of honeycomb cells filled with a filler material, which is bonded to one or more side walls of the plurality of honeycomb cells. In one example embodiment, the filler material includes an abradable material such as nickel chromium aluminum-bentonite, a binder material such as aluminum, and a fluid catalyst such as water. In some embodiments, the abradable material may include at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material may include at least one of aluminum, nickel-aluminum, aluminum thiophosphate, or aluminum thiosulfate. The fluid catalyst may include a solvent with hydroxyl groups.

In some embodiments, the step 302 of placing the filled abradable seal component includes disposing the filled abradable seal component along the clearance defined between a stationary component such as a compressor discharge casing and a rotatable component such as a mid-shaft which is coupled to a compressor and a turbine of the turbomachine. In such an embodiment, the filled abradable seal component is coupled to the compressor discharge casing facing teeth formed in the mid-shaft. In some other embodiments, the step 302 of placing the filled abradable seal component includes disposing the filled abradable seal component along a clearance defined between a tip of a rotatable component such as a rotor blade and a stationary component such as a turbine casing of the turbomachine. In such an embodiment, the filled abradable seal component is coupled to the turbine casing facing teeth formed in the rotor blade. In some other embodiments, the step 302 of placing the filled abradable seal component includes disposing the filled abradable seal component along a clearance defined between a tip of a stationary component such as a stator blade and a rotatable component such as a spacer wheel of the turbomachine. In such an embodiment, the filled abradable seal component is coupled to the turbine casing facing teeth formed in the spacer wheel. In some other embodiments, the step 302 of placing the filled abradable seal component includes disposing the filled abradable seal component along a clearance defined between a stationary component such as a bearing housing and a rotatable component such as an aft-shaft of the turbomachine. In such an embodiment, the filled abradable seal component is coupled to the aft-shaft facing teeth formed in the bearing housing.

The method 300 further includes a step 304 of receiving a flow of a swirling fluid along the clearance from the turbomachine. In some embodiments, the swirling fluid may be by-pass fluid released from the compressor bypassing a combustor of the turbomachine. In some other embodiments, the swirling fluid may be a flow of exhaust gases in the turbine, which is released from the combustor.

The method 300 further includes a step 306 of restraining de-swirling of the swirling fluid by reducing entrapment of the swirling fluid within the filled abradable seal component to regulate the windage heating in the turbomachine. In one embodiment, the filled abradable seal component prevents the movement of the swirling fluid within the plurality of honeycomb cells, which are filled with the filler material, thereby reducing the entrapment of the swirling fluid within the plurality of honeycomb cells. Thus, the filled abradable seal component restrain de-swirling of the swirling fluid, thereby regulating the windage heating along the clearance. Specifically, the filled abradable seal component preserves swirling motion of the swirling fluid along the clearance and decreases tangential slip between the swirling fluid and the rotatable component, thereby decreases the windage heating along the clearance.

The method 300 may further includes a step of regulating the flow of the swirling fluid along the clearance using a plurality of grooves disposed in the filled abradable seal component. In one embodiment, individual grooves of the plurality of grooves are spaced apart from each other along an axial direction of the turbomachine and extends along a circumferential direction of the turbomachine. In some embodiments, the individual grooves of the plurality of grooves may be pre-formed on the filled abradable seal component. For example, the grooves such as at least one of a rectangular groove, a triangular groove, a triangular-rectangular groove, or a convex-rectangular groove may be formed in the filled abradable seal component before the step 302 of placing the filled abradable seal component coupled to either one of the stationary component or the rotatable component of the turbomachine. In some other embodiments, the individual grooves of the plurality of grooves may be formed during the operation of the turbomachine. For example, during certain transient operational conditions of the turbomachine such as startup, the rotatable component may move along the axial direction or a radial direction in relation to the stationary component, thereby causing the teeth in other of the stationary component or the rotatable component to rub against the filled abradable seal component and form the plurality of grooves on the filled abradable seal component. In such an embodiment, each of the plurality of grooves may have different shape without restricting to any a particular shape such as rectangular groove, a triangular groove, a triangular-rectangular groove, or a convex-rectangular groove.

Figure 5:
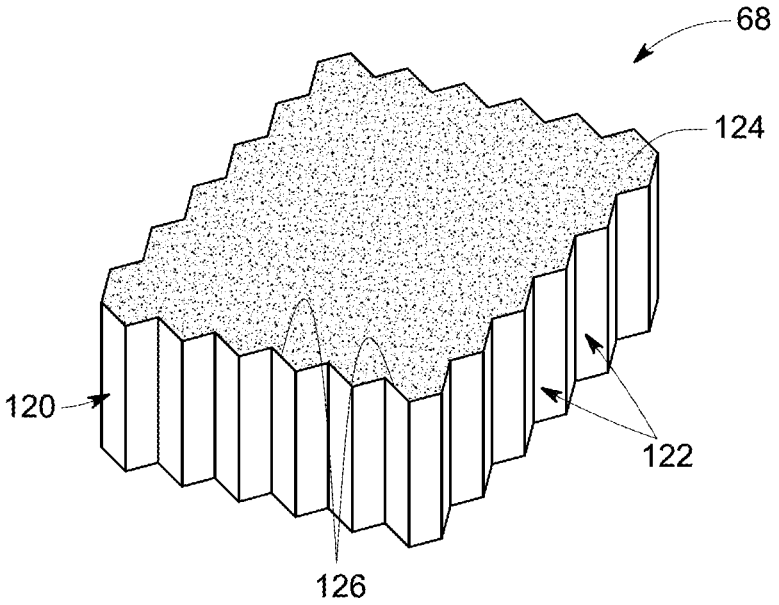
FIG. 5 is a perspective view of a filled abradable seal component in accordance with one example embodiment of the present disclosure.

FIG. 5 illustrates a perspective view of a filled abradable seal component 68 in accordance with one example embodiment of the present disclosure. In one embodiment, the filled abradable seal component 68 is an abradable seal component 120 including a plurality of honeycomb cells 122. The plurality of honeycomb cells 122 is disposed adjacent to each other and filled with a filler material 124. In such an embodiment, the filler material 124 is bonded to one or more side walls 126 of the plurality of honeycomb cells 122. In the illustrated embodiment, the filler material 124 is filled completely in an internal volume of some of the plurality of honeycomb cells 122. Although not illustrated, in some other embodiments, the filler material 124 may be filled completely in the internal volume of all honeycomb cells of the plurality of honeycomb cells 122.

In some embodiments, the filler material 124 includes an abradable material, a binder material, and a fluid catalyst. It should be noted herein the fluid catalyst may be used to initiate reaction between the abradable material and the binder material to bond to the abradable material and/or the binder to the one or more side walls 126 of the plurality of honeycomb cells 122. In certain embodiments, the abradable material includes at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride. The binder material includes at least one of aluminum, nickel-aluminum, aluminum thiophosphate, or aluminum thiosulfate. The fluid catalyst includes a solvent with hydroxyl groups. In one example embodiment, the abradable material is nickel chromium aluminum-bentonite, the binder material is aluminum, and the fluid catalyst is water.

Figure 6:
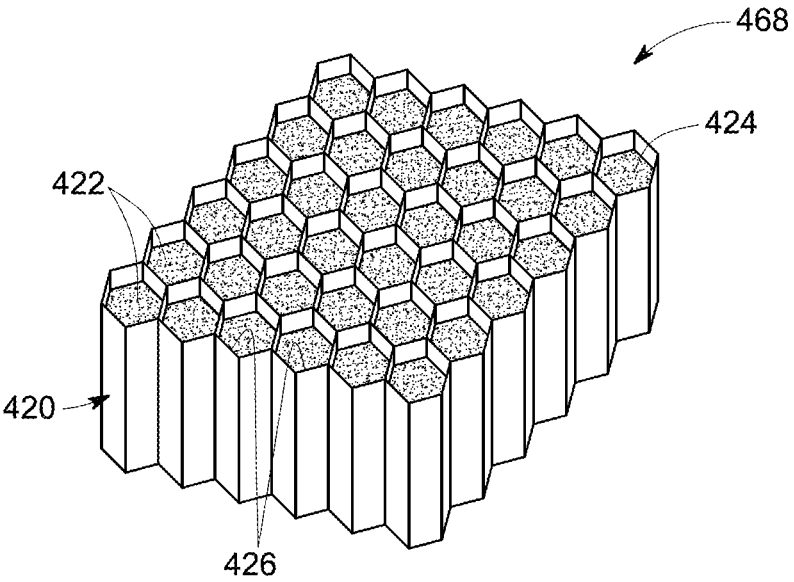
FIG. 6 is a perspective view of a filled abradable seal component in accordance with another example embodiment of the present disclosure.

FIG. 6 illustrates a perspective view of a filled abradable seal component 468 in accordance with another example embodiment of the present disclosure. In one embodiment, the filled abradable seal component 468 includes an abradable seal component 420 including a plurality of honeycomb cells 422 filled with a filler material. In such an embodiment, the filler material 424 is bonded to one or more side walls 426 of the plurality of honeycomb cells 422. In the illustrated embodiment, the filler material 424 is filled partially in an internal volume of some of the plurality of honeycomb cells 422. The filled abradable seal component 468 may be configured to regulate windage heating along a clearance. In some embodiments, the filler material 424 may be filled in a range from 75 percent to 95 percent of the internal volume of at least some of the plurality of filled honeycomb cells 422. In one example embodiment, the filled abradable seal component 468 has 95 percent of the internal volume filled with the filler material 424. In such an embodiment, the filled abradable seal component 468 may additionally allow substantially little quantity of the swirling fluid to move into the plurality of honeycomb cells, thereby entrapping the little quantity of the swirling fluid in the honeycomb cells, and resulting in regulating both the winding heating and the leakage of the swirling fluid along the clearance.

Figure 7:
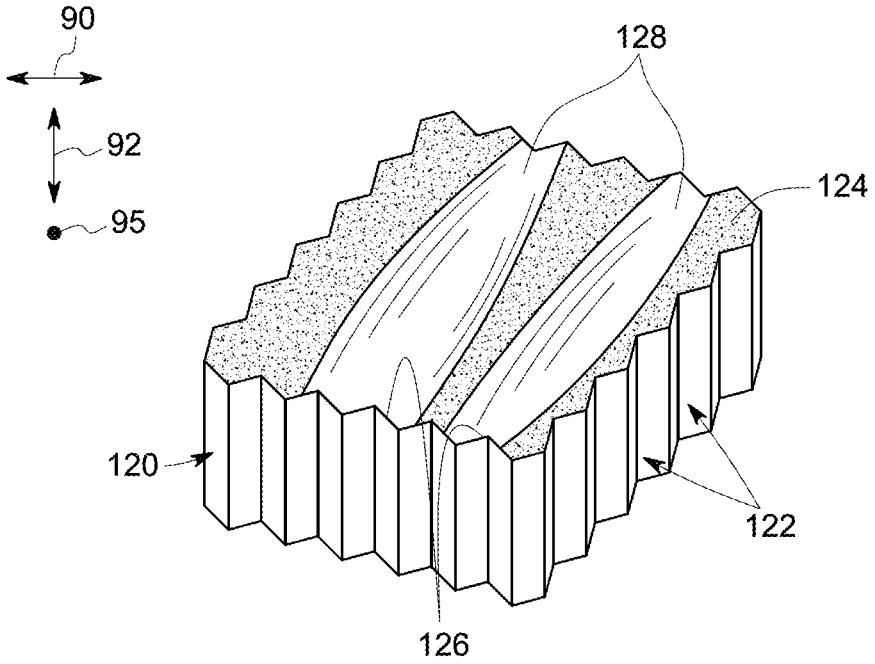
FIG. 7 is a perspective view of a filled abradable seal component including a plurality of grooves in accordance with one example embodiment of the present disclosure.

FIG. 7 illustrates a perspective view of a filled abradable seal component 68 including a plurality of grooves 128 in accordance with one example embodiment. In one embodiment, the plurality of grooves 128 is formed in the filled abradable seal component 68. Specifically, individual grooves of the plurality of grooves 128 are spaced apart from each other along an axial direction 90 of a turbomachine and extending along a circumferential direction 92 of the turbomachine. As discussed herein, the plurality of grooves 128 may be formed during operation of the turbomachine. For example, during certain transient operational conditions of the turbomachine such as startup, a rotatable component of the turbomachine may move along the axial direction 90 or a radial direction 95 of the turbomachine in relation to a stationary component of the turbomachine, thereby causing teeth in other of the stationary component or the rotatable component to rub against the filled abradable seal component 68 and form the plurality of grooves 128 on the filled abradable seal component 68. Such a filled abradable seal component 68 may regulate windage heating along a clearance and also control leakage of the swirling fluid through the clearance.

Figure 8:
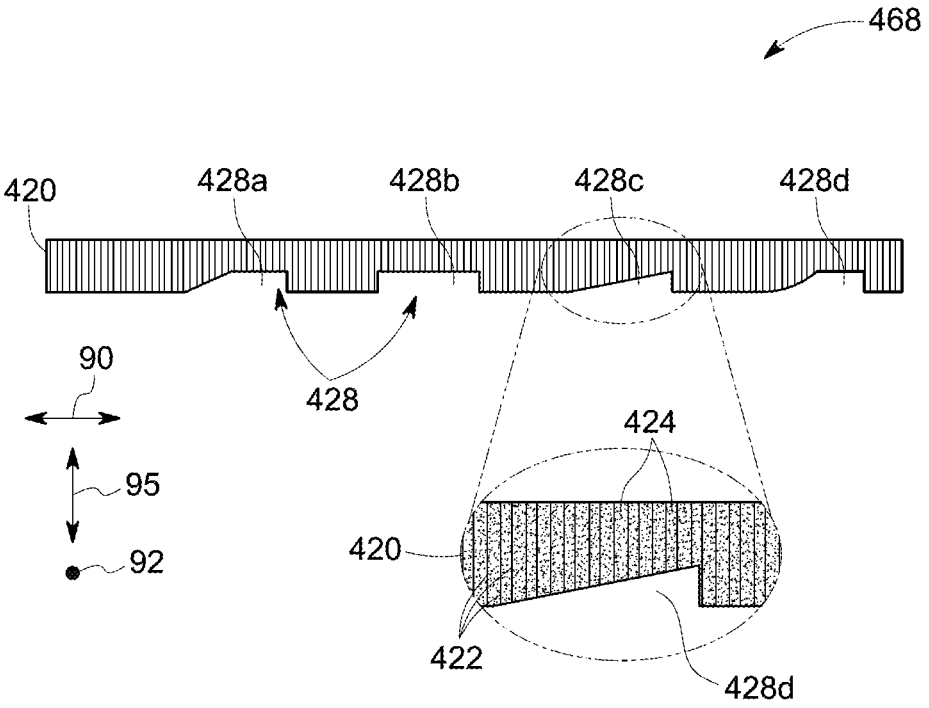
FIG. 8 is a schematic diagram of a filled abradable seal component including a plurality of grooves in accordance with another example embodiment of the present disclosure.

FIG. 8 illustrates a schematic diagram of an abradable seal component 468 including a plurality of grooves 428 in accordance with another example embodiment. In one embodiment, the plurality of grooves 428 is formed in the filled abradable seal component 468. Individual grooves of the plurality of grooves 428 are spaced apart from each other along an axial direction 90 of a turbomachine and extends along a circumferential direction 92 of the turbomachine. As discussed herein, the plurality of grooves 428 may be pre-formed in the filled abradable seal component 468 using machines such as drilling machine, grouting machine, and the like. For example, the plurality of grooves 428 includes at least one of a triangular-rectangular groove 428*a*, a rectangular groove 428*b*, a triangular groove 428*c*, or a convex-rectangular groove 428*d*. The filled abradable seal component 468 may be coupled to either one of a stationary component or a rotatable component of the turbomachine and facing teeth of other of the stationary component or the rotatable component to define a clearance there between. For example, the filled abradable seal component 468 may be coupled using brazing technique. During operation, the filled abradable seal component 468 may regulate windage heating along a clearance and control leakage of the swirling fluid through the clearance. Specifically, the plurality of filled honeycomb cells 422 may i) restrain de-swirling of the swirling fluid by reducing movement of the swirling fluid within the plurality of honeycomb cells 422 and entrapment of the swirling fluid within the plurality of filled honeycomb cells 422, thereby regulating the windage heating along the clearance and ii) regulate a flow of the swirling fluid through the clearance, using the plurality of grooves 428 and the teeth, thereby reducing an amount of the swirling fluid flowing through the clearance.

Figure 9:
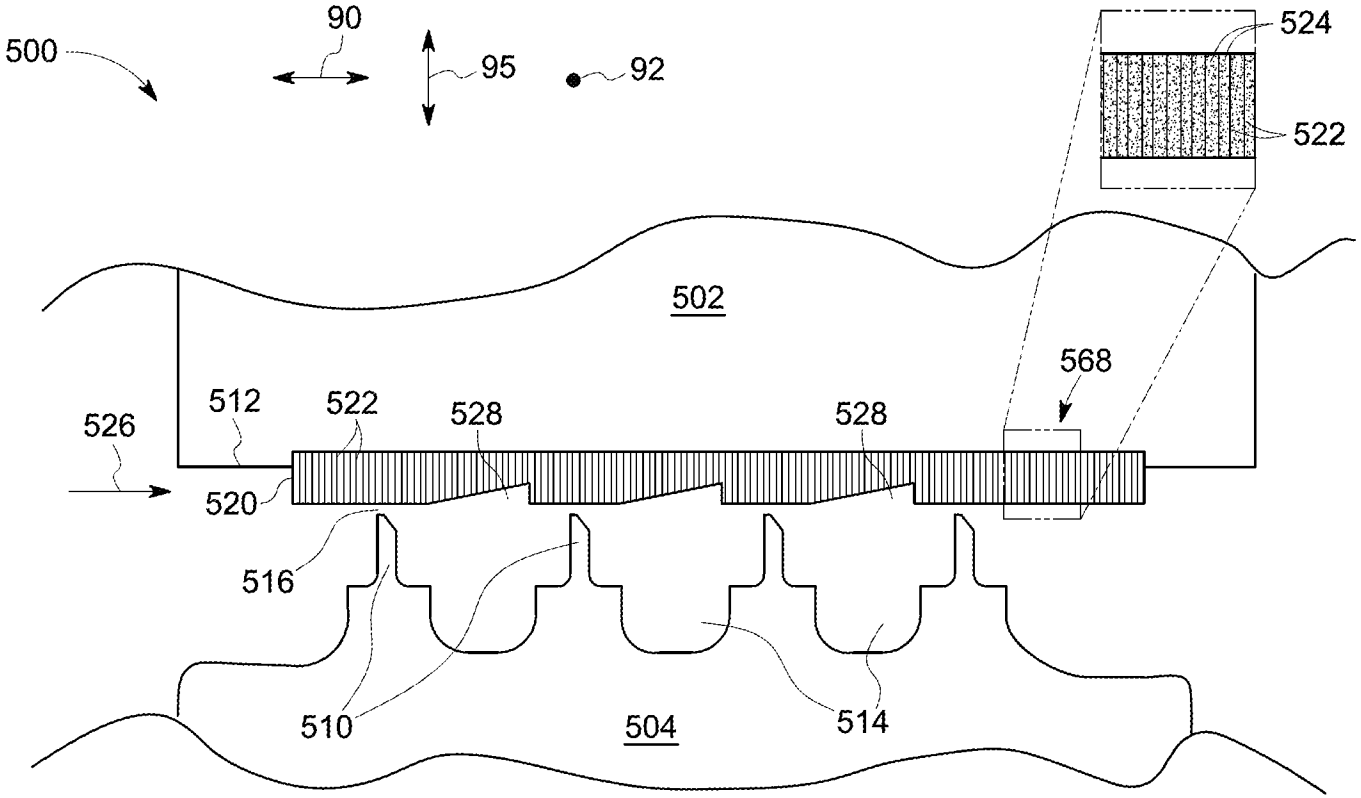
FIG. 9 is a schematic diagram of a filled abradable seal component coupled to a stationary component, and facing a rotatable component of a turbomachine in accordance with one example embodiment of the present disclosure.

FIG. 9 illustrates a schematic diagram of a filled abradable seal component 568 coupled to a turbomachine 500 in accordance with one example embodiment of the present disclosure. The turbomachine 500 includes a stationary component 502, a rotatable component 504, and the filled abradable seal component 568. The filled abradable seal component 568 includes a plurality of honeycomb cells 522 filled with a filler material 524, and a plurality of triangular-rectangular grooves 528 formed in the plurality of honeycomb cells 522 filled with the filler material 524. In other words, the plurality of triangular-rectangular grooves 528 is formed in the filled abradable seal component 568 only after the plurality of honeycomb cells 522 are filled and cured the filler material. The plurality of honeycomb cells 522 filled with the filler material 524 is disposed facing teeth 510 of the rotatable component 504 to define a clearance 516 there between. The filled abradable seal component 568 is coupled to a surface 512 of the stationary component 502 such that each triangular-rectangular groove 528 faces a seal pocket from a plurality of labyrinth seal pockets 514 formed between adjacent teeth 510 of the rotatable component 504.

During operation, the plurality of honeycomb cells 522 filled with the filler material 524 is configured to regulate windage heating along the clearance 516 and the plurality of triangular-rectangular grooves 528 is configured to regulate a flow of a swirling fluid 526 through the clearance 516. In some embodiments, the plurality of honeycomb cells 522 filled with the filler material 524 reduces entrapment of the swirling fluid 526 within the plurality of honeycomb cells 522 resulting in restraining de-swirling of the swirling fluid 526 within the plurality of honeycomb cells 522, thereby regulating the windage heating along the clearance 516. A flow of the swirling fluid 526 through the clearance 516 is regulated using the plurality of triangular-rectangular grooves 528, the teeth 510, and the plurality of labyrinth seal pockets 514. In one example embodiment, regulating the swirling fluid 526 may involve recirculating a portion of the swirling fluid 526 within each triangular-rectangular groove 528 and then deflecting the portion of the swirling fluid 526 using each triangular-rectangular groove 528 to each labyrinth seal pocket 514 to further recirculate the portion of the swirling fluid 526 within each labyrinth seal pocket 514, thereby restraining the flow of the swirling fluid 526 through the clearance 516.

Figure 10:
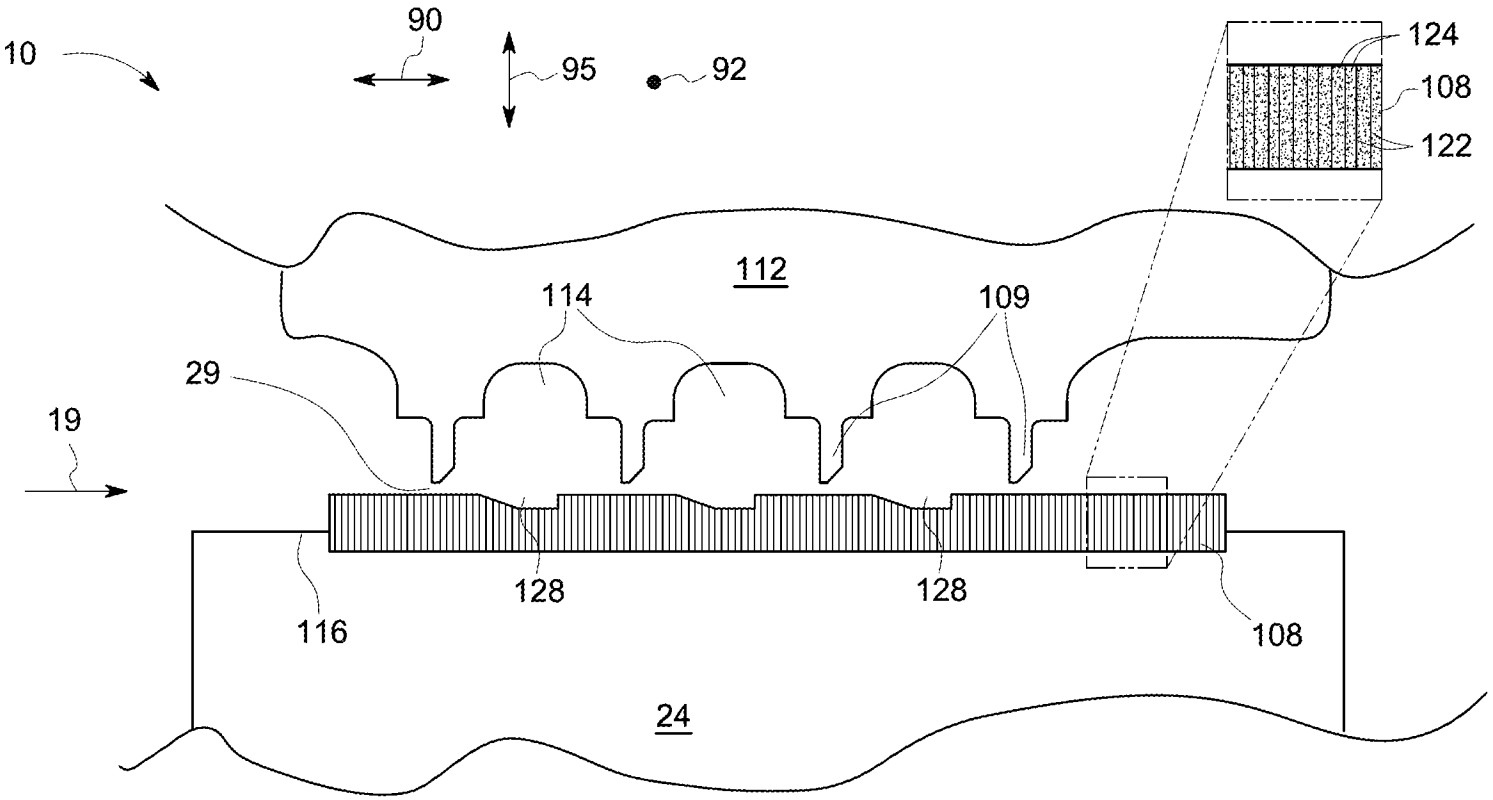
FIG. 10 is a schematic diagram of a filled abradable seal component coupled to a rotatable component, and facing a stationary component of a turbomachine in accordance with another example embodiment of the present disclosure.

FIG. 10 illustrates a schematic diagram of a filled abradable seal component 108 coupled to a turbomachine such as a gas turbine engine 10 in accordance with another example embodiment. The gas turbine engine 10 includes the rotatable component such as the aft-shaft 24 and the stationary component such as the bearing housing 112 having teeth 109, and the filled abradable seal component 108. The filled abradable seal component 108 includes a plurality of honeycomb cells 122 filled with a filler material 124, and a plurality of triangular-rectangular grooves 128 formed in the plurality of honeycomb cells 122 filled with the filler material 124. The plurality of honeycomb cells 122 filled with the filler material 124 is disposed facing teeth 109 of the bearing housing 112 to define clearance 29 there between. The filled abradable seal component 108 is coupled to a surface 116 of the aft-shaft 24 such that each triangular-rectangular groove 128 faces a seal pocket from a plurality of labyrinth seal pockets 114 formed between adjacent teeth 109 of the bearing housing 112.

During operation, the plurality of honeycomb cells 122 filled with the filler material 124 is configured to regulate windage heating along the clearance 29 and the plurality of triangular-rectangular grooves 128 is configured to regulate a flow of a swirling fluid such as the exhaust gases 19 through the clearance 29. In some embodiments, the plurality of honeycomb cells 122 filled with the filler material 124 reduces movement of the exhaust gases 19 in the plurality of honeycomb cells 122, thereby regulating the entrapment of the exhaust gases 19 within the plurality of honeycomb cells 122. Thus, the plurality of honeycomb cells 122 filled with the filler material 124 results in restraining de-swirling of the exhaust gases 19 within the plurality of honeycomb cells 122, thereby regulating the windage heating along the clearance 29. A flow of the exhaust gases 19 through the clearance 29 is regulated using the plurality of triangular-rectangular grooves 128, the teeth 109, and the plurality of labyrinth seal pockets 114. In one example embodiment, regulating the exhaust gases 19 may involve recirculating a portion of the exhaust gases 19 within each triangular-rectangular groove 128 and then deflecting the portion of the exhaust gases 19 using each triangular-rectangular groove 128 to each labyrinth seal pocket 114 to further recirculate the portion of the exhaust gases 19 within each labyrinth seal pocket 114, thereby restraining the flow of the exhaust gases 19 through the clearance 29.

In accordance with one or more embodiments discussed herein, a filled abradable seal component may be configured to regulate windage heating along a clearance of a turbomachine. Further, the filled abradable seal component having a plurality of grooves may be further configured to regulate a flow of swirling fluid along the clearance. The filled abradable seal component may be manufactured using a filler material filled within at least some of a plurality of honeycomb cells of an abradable seal component at an ambient temperature, for example, temperature ranging from 20 degrees Centigrade to 30 degrees Centigrade, without melting the filler material.

While only certain features of embodiments have been illustrated, and described herein, many modifications and changes will occur to those skilled in the art. It is, therefore, to be understood that the appended embodiments are intended to cover all such modifications and changes as falling within the spirit of the disclosure.

What we claim is:

1. A method of manufacturing a filled abradable seal component for a turbomachine, comprising:

positioning an abradable seal component comprising a plurality of honeycomb cells;

applying a filler material on the abradable seal component to fill the plurality of honeycomb cells, wherein the filler material comprises an abradable material, a binder material, and a fluid catalyst, wherein:

the abradable material comprises at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride;

the binder material comprises at least one of aluminum, nickel-aluminum, aluminum thiophosphate, or aluminum thiosulfate; and the fluid catalyst comprises a solvent comprising hydroxyl groups; and reacting and curing the filler material within the plurality of honeycomb cells at a temperature below 250 degrees Celsius to form a reacted mixture from the filler material and produce the filled abradable seal component.

2. The method of claim 1, wherein reacting and curing the filler material within the plurality of honeycomb cells is performed at a temperature ranging from 20 degrees Celsius to 30 degrees Celsius.

3. The method of claim 1, wherein applying the filler material comprises:

mixing the abradable material and the binder material to produce a mixture;

filling the mixture in the plurality of honeycomb cells; and providing the fluid catalyst to the mixture filled in the plurality of honeycomb cells.

4. The method of claim 1, wherein applying the filler material comprises:

mixing the abradable material and the binder material to produce a mixture;

mixing the fluid catalyst with the mixture to produce a slurry; and filling the slurry in the plurality of honeycomb cells.

5. The method of claim 1, wherein reacting and curing the filler material within the plurality of honeycomb cells is performed below a melting point of the filler material.

6. A filled abradable seal component for a turbomachine, comprising:

an abradable seal component comprising a plurality of honeycomb cells filled with a reacted mixture bonded to one or more side walls of the plurality of honeycomb cells, wherein the reacted mixture is formed from a filler material comprising an abradable material, a binder material, and a fluid catalyst being reacted and cured within the plurality of honeycomb cells at a temperature below 250 degrees Celsius, and wherein:

the abradable material comprises at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride;

the binder material comprises at least one of aluminum, nickel-aluminum, aluminum thiophosphate, or aluminum thiosulfate; and the fluid catalyst comprises a solvent comprising hydroxyl groups.

7. The filled abradable seal component of claim 6, further comprising a plurality of grooves disposed on the filled abradable seal component, wherein individual grooves of the plurality of grooves are spaced apart from each other along an axial direction of the turbomachine and extending along a circumferential direction of the turbomachine.

8. The filled abradable seal component of claim 7, wherein the plurality of grooves comprises at least one of a rectangular groove, a triangular groove, a triangular-rectangular groove, or a convex-rectangular groove.

9. The filled abradable seal component of claim 6, wherein the binder material is selected from the group consisting of aluminum, nickel-aluminum, aluminum thiophosphate, aluminum thiosulfate, and combinations thereof.

10. The filled abradable seal component of claim 6, wherein a volume ratio of the abradable material to the binder material in the filler material is in a range from 0.5 to 3.

11. The filled abradable seal component of claim 10, wherein the volume ratio of the abradable material to the binder material in the filler material is 1.

12. The filled abradable seal component of claim 6, wherein the solvent is selected from the group consisting of an alcohol, an aqueous hydroxide, and combination thereof.

13. The filled abradable seal component of claim 6, wherein the abradable material comprises nickel chromium aluminum-bentonite, the binder material comprises aluminum, and the fluid catalyst comprises water.

14. A turbomachine comprising:

a stationary component;

a rotatable component; and a filled abradable seal component coupled to either one of the stationary component or the rotatable component of the turbomachine and facing teeth of other of the stationary component or the rotatable component to define a clearance therebetween, wherein the filled abradable seal component comprises:

an abradable seal component comprising a plurality of honeycomb cells filled with a reacted mixture bonded to one or more side walls of the plurality of honeycomb cells, wherein the reacted mixture is formed from a filler material comprising an abradable material, a binder material, and a fluid catalyst being reacted and cured within the plurality of honeycomb cells at a temperature below 250 degrees Celsius, and wherein:

the abradable material comprises at least one of nickel chromium aluminum-bentonite, cobalt nickel chromium aluminum yttrium-polyester, cobalt nickel chromium aluminum yttrium-boron nitride, aluminum silicon-bentonite, aluminum bronze-polyester, nickel graphite, or aluminum silicon-boron nitride;

the binder material comprises at least one of aluminum, nickel-aluminum, aluminum thiophosphate, or aluminum thiosulfate; and the fluid catalyst comprises a solvent comprising hydroxyl groups.

15. The turbomachine of claim 14, further comprising a plurality of grooves disposed on the filled abradable seal component, wherein individual grooves of the plurality of grooves are spaced apart from each other along an axial direction of the turbomachine and extending along a circumferential direction of the turbomachine.

16. The turbomachine of claim 14, wherein the stationary component is a compressor discharge casing of the turbomachine, wherein the rotatable component is a mid-shaft of the turbomachine, and wherein the clearance is between the compressor discharge casing and the mid-shaft.

17. The turbomachine of claim 14, wherein the stationary component is a turbine casing of the turbomachine, wherein the rotatable component is a rotor blade of the turbomachine, and wherein the clearance is between the turbine casing and a tip of the rotor blade.

18. The turbomachine of claim 14, wherein the stationary component is a stator blade of the turbomachine, wherein the rotatable component is a spacer wheel of the turbomachine, and wherein the clearance is between a tip of the stator blade and the spacer wheel.

19. The turbomachine of claim 14, wherein the stationary component is a bearing housing of the turbomachine, wherein the rotatable component is an aft-shaft of the turbomachine, wherein the clearance is defined between the bearing housing and the aft-shaft.

20. The turbomachine of claim 14, wherein the binder material is selected from the group consisting of aluminum, nickel-aluminum, aluminum thiophosphate, aluminum thiosulfate, and combinations thereof.

* * * * *